US005123400A

United States Patent [19]

Edgerton

[11] Patent Number: 5,123,400

[45] Date of Patent: Jun. 23, 1992

[54] SAW CHAIN HAVING HEADLESS FASTENER

[75] Inventor: John L. Edgerton, Canby, Oreg.

[73] Assignee: Blount, Inc., Portland, Oreg.

[21] Appl. No.: 718,223

[22] Filed: Jun. 20, 1991

[51] Int. Cl.[5] ..... B27B 17/00

[52] U.S. Cl. ..... 125/21; 83/698; 83/830; 411/500

[58] Field of Search ..... 83/833, 830, 831, 832, 83/834, 698; 403/79, 152, 154, 155, 163; 125/21; 411/350, 500

[56] References Cited

U.S. PATENT DOCUMENTS

| | | | |
|---|---|---|---|
| 1,637,247 | 7/1927 | Snyder | 403/155 |
| 2,652,076 | 9/1953 | Bye | 83/834 |
| 2,713,806 | 7/1955 | Dodge | 403/152 |
| 2,747,624 | 5/1956 | Cox | 83/831 |
| 2,792,035 | 5/1957 | Aumann | 93/834 |
| 4,750,886 | 6/1988 | Portelli et al. | 403/163 |

FOREIGN PATENT DOCUMENTS

| | | | |
|---|---|---|---|
| 0809711 | 5/1951 | Fed. Rep. of Germany | 83/830 |

*Primary Examiner*—Frank T. Yost
*Assistant Examiner*—Allan M. Schrock
*Attorney, Agent, or Firm*—Robert L. Harrington

[57] ABSTRACT

A saw chain having center links and side link pairs that are pivotally joined by a headless fastener. The side link pairs are formed into an integral unit, by a bridge portion to receive a center link therebetween. The center link and the side link pair have aligned bores for receiving a fastener. The fastener has a center section that is rotatably received in the bore of the center link and has larger end sections on each side of the center section that are received in the bores of the side link pair. The diameter of the center section of the fastener is smaller than the diameter of the end sections. The bore of the center link is of a smaller diameter than the bores in the side link pair. The fastener is forcibly inserted into the aligned bores of the side link pair and the center link. The forced insertion of the fastener forces the bore of the center link to enlarge permitting an end section of fastener to pass through with the center section of the fastener residing in the bore of the center link. The bore of the center link returns to its original dimension to capture the fastener in the assembly. The fastener has a length corresponding to the width of the side link pair and therefore does not extend beyond either side of the pair.

7 Claims, 2 Drawing Sheets

SAW CHAIN HAVING HEADLESS FASTENER

BACKGROUND INFORMATION

1. Field of the Invention

This invention relates to a saw chain of pivotally interconnected links wherein the pivotal connections are headless fasteners.

2. Background of the Invention

Saw chain is typically constructed with alternating center links and side link pairs that are pivotally interconnected by rivets. The rivet holes of the center link are of a larger diameter than the rivet holes of the side links. The rivet is configured with a center section that fits the center link rivet hole and has end sections of reduced diameter &:o fit the rivet holes of the side links. The center section of the rivet has a width slightly greater than the width of the center link to prevent the side links from pinching against the center link. The end sections of the rivets protrude through the side links and a head is formed on each end of the rivet to prevent the side links (and center link sandwiched between the side links) from coming off the rivets. At least one of the heads has to be formed after assembly, e.g. by spinning, which is a relatively expensive operation.

The protruding heads of the rivets at each side of the chain adds undesirable width to the chain. This requires the cutters of the chain to produce a kerf sufficiently wide to prevent the heads of the rivets protruding from each side of the chain from binding or rubbing against the side of the kerf produced.

Saw chain used for cutting aggregate material (rock and masonry) is different than the typical saw chain. The cutting element which is often a diamond impregnated steel block bridges across and is rigidly attached to the two side links of select pairs of side links. The block width extends beyond the sides of the side links as necessary to encompass the rivet heads. The diamond impregnated block is expensive and the added width of the rivet heads adds undesirable extra cost to the cost of the chain.

It is an object of the present invention to provide a headless fastener to replace the headed rivet and particularly as concerns saw chain for cutting aggregate materials.

SUMMARY OF THE INVENTION

With reference to the aggregate cutting chain described above, the attachment of the cutting block to the pair of side links makes the side link pair an integral member that is in the form of a rigid U shape. In actual practice, all of the cutting block side link pairs are preferably rigidly attached together by a bridging element. This rigid interconnection of the side links of the pair in spaced apart relation provides the opportunity for a unique headless fastener (sometimes referred to as headless rivets).

As compared to the typical saw chain structure, the present structure provides rivet (fastener) holes in the center link that are slightly smaller than the rivet holes in the interconnected side link pair. A headless rivet is provided with a center section that matches the dimension of the center link hole and the rivet has end sections of increased dimension that match the diameter of the holes of the integral side link pair. The material surrounding the center link hole (i.e. the center link steel material) and/or the material of the rivet has limited elasticity. That is, it can be forcibly deformed a slight amount and upon removal of the deforming force it will return substantially to its original shape. The difference in diameters as between the rivet hole of the center link and the end section of the rivet and the materials used are designed to require a press fit insertion of the rivet end sections through the center link hole. The force required to force the end section of the rivet through the rivet hole of the center link is within the range of about 1,000–2,000 pounds. An end section of the rivet can thus be forced through the center link hole until the center section of the rivet resides in the hole. The deformed material returns to its original shape and removal of the rivet requires a similar or greater press force.

The press fit of the rivet into the center link hole is accomplished with the center link and side link holes aligned. With the rivet's center section residing in the center link hole, the end sections of the rivet reside in the holes of the integral side link pair but they do not protrude beyond either side of the integral side link pair. Because the side links are fixed together, they cannot become detached from the rivet without one of the end sections of the rivet being first forced through the center link hole. The result is a secure attachment without a rivet head protruding beyond either side of the integral side link pair.

An added benefit is obtained from the force fitting of the rivet through the center link hole. The forced insertion of the end section of the rivet into and through the center link hole relieves internal stresses in the material surrounding the center link hole. This is known to reduce the likelihood of the occurrence of stress cracks surrounding the holes of the center link.

An alternative to relying solely on the elasticity of the material of the center link and rivet is to provide a slit extending from the center link hole. The slit allows the hole in the center link to expand slightly as the end section of the rivet is forced through the center link hole. Typically a single slit is provided that extends between the two rivet holes of the center link.

A second alternative is to provide the center link hole substantially equal to the dimension of the rivet end sections. A counter bore in one side of the center link concentric with the rivet hole receives a snap ring that has a closed inner diameter matching the reduced center section of the rivet (the center section in this case being a groove that receives the snap ring). The snap ring is positioned in the counter bore and the center link hole is aligned with holes of the integral side link pair. The rivet is inserted through the aligned holes, forcing the snap ring open until it lines up with the rivet groove. Once the snap ring is in place in the groove, the rivet cannot be removed without applying a special tool to open (i.e., expand) the snap ring. The snap ring groove is located on the rivet to position the rivet ends within the side link holes and not extended beyond either side of the integral side link pair.

The invention will be more clearly understood by reference to the following detailed description and attached drawings.

DESCRIPTION OF THE PREFERRED EMBODIMENT

Figure 1:
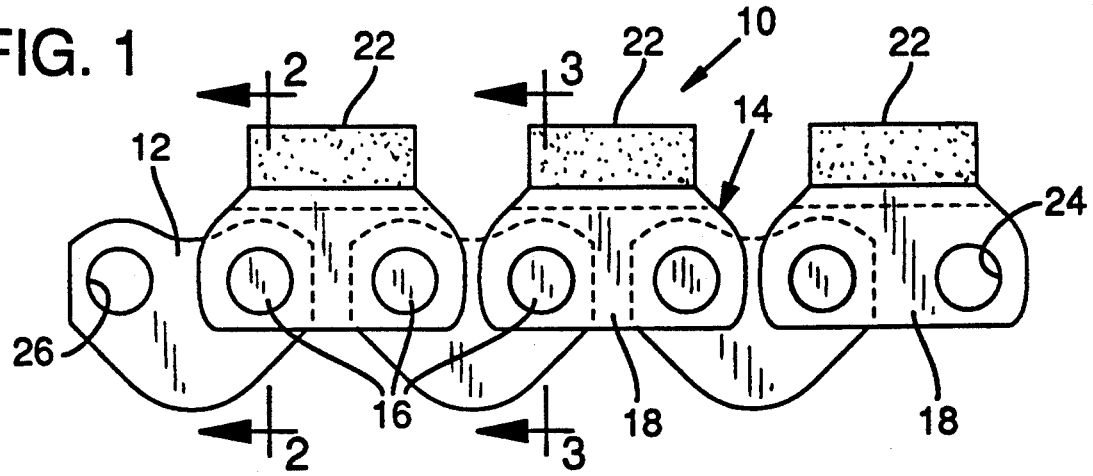
FIG. 1 is a side view of a saw chain of the present invention.
Figure 2:
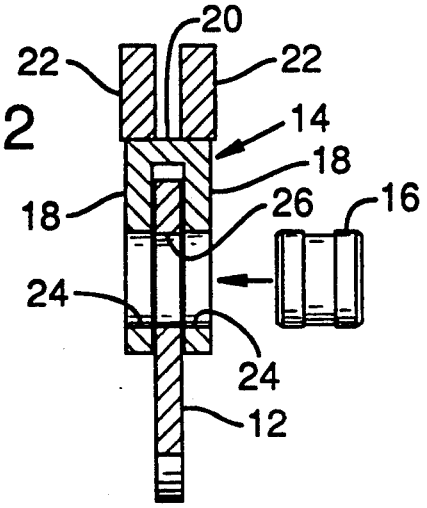
FIG. 2 is a view as viewed on view lines 2—2 of FIG. 1.
Figure 3:
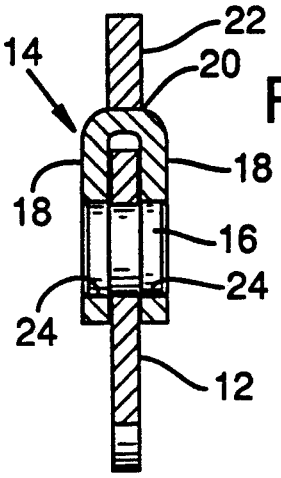
FIG. 3 is a view as viewed on view lines 3—3 of FIG. 1.

FIGS. 1-3 of the drawings illustrate a portion of a saw chain 10 suited for cutting hard abrasive materials such as concrete, masonry, stone and the like (hereafter collectively referred to as aggregate materials). The saw chain 10 is an articulated chain, having center links 12 (also referred to as drive links) and opposed side links 18 pivotally joined to the center links by fasteners 16. The opposed side links 18 are spaced at a distance from each other in a parallel attitude and fixedly joined by a bridge (top) 20. The side links 18 of the integral link 14 are spaced apart a distance to receive the center link 12. Hereafter the opposed side links 18 and interconnecting bridge 20 are collectively referred to as integral side link 14.

In this embodiment the saw chain 10 has cutting blocks 22 affixed to the bridge 20 of the integral link 14 as by laser welding. As seen in FIG. 2, two cutting blocks 22 are affixed to the bridge 20 of one integral link 14 and in FIG. 3, one cutting block 22 is affixed to the bridge 20 of another integral link 14. (Whereas the integral link of FIG. 3 has rounded corners as compared to the square corners of FIG. 2, this is a matter of form and manufacturing convenience, the square corners providing more surface area for the paired cutting blocks. No distinction will otherwise be made between the two integral side links and will thus be collectively referred to as integral link 14.

The chain 10 is assembled with alternating cutting blocks, that is one integral link 14 with two cutting blocks will be succeeded by an integral link 14 with one cutting block. As seen in FIG. 2, the two cutting blocks 22 are in a spaced relation with a side edge of each cutting block extending just beyond the edge of the integral link 14. The cutting block 22 in FIG. 3 is positioned centrally on the bridge 20 of the integral link 14. The cutting block of FIG. 3 removes material within the gap of the spaced cutters of FIG. 2.

Still referring to FIGS. 2 and 3, the integral link 14 has aligned through bores 24 in the side links 18 for receiving the fastener 16. As seen in FIG. 1, each integral link 14 will receive two fasteners 16 and thus the integral link 14 has two sets of aligned bores 24 in the side links 18.

The center link 12 likewise has two through bores 26 for receiving the fasteners 16. One of the bores 26 of the center link 12 is alignable with a set of the through bores 24 of the integral link 14 with an end of the center link positioned between the spaced apart side links 18. The other bore 26 is alignable with a set of bores 24 in another integral link 14. The bores 26 in the center link 12 are of a smaller diameter than the through bores 24 in the integral link 14.

Figure 4:
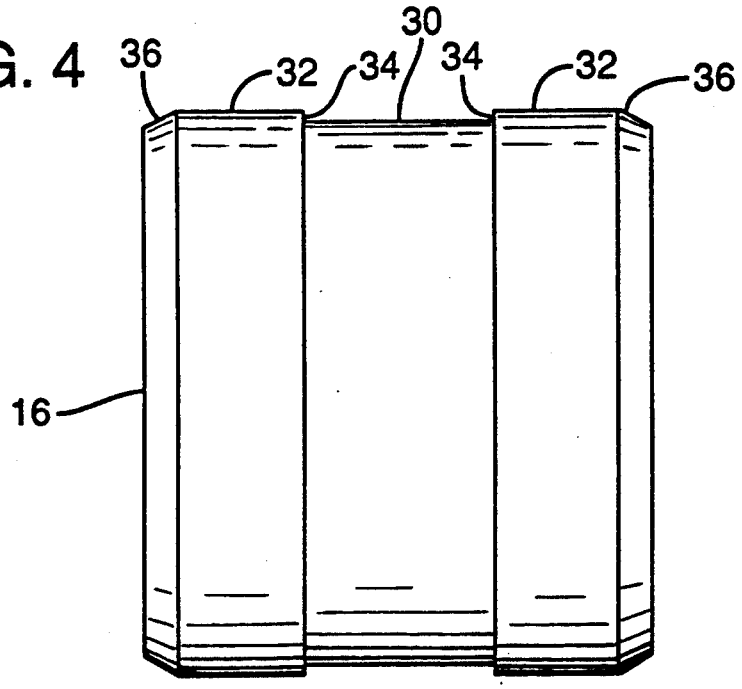
FIG. 4 is an enlarged view of a headless fastener as used in the embodiment of FIG. 1.

Refer now to FIG. 4 of the drawings wherein the headless fastener 16 is enlarged many times for illustration purposes. The headless fastener 16 is a cylindrical member having a center section 30 and end sections 32. As shown, the diameters of the end sections 32 ar equal. The diameter of the center section 30 is less than the diameter of the end sections 32. The length of the fastener 16 corresponds to the width of the integral link 14 (see the fastener 16 of FIG. 2 prior to installation and after installation in FIG. 3). Neither end of the headless fastener 16 will extend beyond the outer edge of the integral link 14 when installed in the aligned bores 24, 26. The length of the center section 30 is only slightly greater than the width of the center link 12. A shoulder 34 is formed at each end of the center section 30, the shoulders 34 being at the juncture of the center section 30 with each end section 32. A taper 36 is formed at each end of the headless fastener 16, one on each of the end sections 32. The length of each end section 32, including the tapered portion 36, corresponds closely to the width of its associated side link 18.

As by way of example, typical dimensions of the integral side link 14, the center link 12 and the headless fastener 16 are given for a ¾ pitch quarry chain. The dimensions are in inches.

| | |
|---|---|
| A. Diameter of center link hole (bore) 26 | 0.306/0.307 |
| B. Width of center link 12 | 0.124/0.120 |
| C. Diameter of integral link hole (bore) 24 | 0.312/0.314 |
| D. Width of side link 18 | 0.126/0.122 |
| E. Diameters of end sections 32 of fastener 16 | 0.312/0.311 |
| F. Diameter of center section 30 of fastener 16 | 0.305/0.303 |
| G. Length of end section 32 | 0.115 |
| H. Length of center section 30 | 0.125/0.130 |

Refer once again to FIGS. 2, 3 and 4 of the drawings. Recall that the dimension (i.e. diameter) of the bore 26 in the center link 12 is less than the dimension (i.e. diameter) of the aligned bores 24 in the integral link 14. The center section 30 of the headless fastener 16 is dimensioned to fit rotatably in the bore 26 in the center link 12. The end sections 32 of the headless fastener 16 are dimensioned to fit rotatably in the bores 24 of the side links 18 of the integral link 14. The end sections 32 of the headless fastener 16 are however of a larger dimension than the bore 26 in the center link 12.

ASSEMBLY OF CHAIN

The assembly of the chain 10 requires the installation of the headless fastener 16 into the aligned bores of the integral link 14 and center link 12. The center link 12 is positioned between the side links 18 of the integral link 14 with the bores 24 and 26 in alignment (see FIG. 2). One end section 32 of the headless fastener 16 is inserted into one of the bores 24. Recall that the end section 32 will fit rotatably in the bore 24. The end section 32 of the headless fastener 16 is, however, dimensioned larger than the bore 26 of the center link 12. The end section 32 of the headless fastener 16 must then be forced into and through the bore 26 as by a press. As the headless fastener 16 is forced through the bore 26, the center section 30 of the headless fastener 16 will be received in the bore 26 of the center link 12 and an end section 32 will be received in each of the bores 24 of the integral link 14.

As the end section 32 of the headless fastener 16 is forced through the bore 26 of the center link 12, the bore 26 is forced to enlarge. The material of the center link 1 and of the integral link 14 are of a very hard material. The material does, however, have elasticity. That is, the material may be forced to deform and upon removal of the deforming force, the material will return to its original shape. The chamfer 36 (i.e. taper) on the end of the headless fastener 16 aids in forcing the bore 26 to enlarge by compressing the material surrounding the bore 26 rather than upsetting or shearing the material.

Insertion of the fastener into the restricted opening 26 is believed aided by the support provided by the opposite side link 18. The center link 12 fitting between the side links 18 of the integral link 14 will have a side surface of the center link in abutment with a side surface of the opposite side link 18. The surface of this link 18 in abutment with the surface of the center link acts as a bolster, that is, it supports the material surrounding the center link hole to prevent the material from being upset. The opposite side link is of course supported in a conventional manner to oppose the force applied to insert the fastener. Recall that the dimension of the center link hole is only a few thousands of an inch less than the hole in the side links 18. Additionally, the difference in the dimensions of the end section 32 and the bore 26 is within a few thousands of an inch. The center link bore 26 (hole) is thus forced to enlarge as the end section 32 of the headless fastener 16 is forced through the bore 26.

As the end section 32 of the headless fastener 16 is forced through the bore 26 of the center link 12, the center section 30 of the headless fastener 16 will be positioned to reside within the bore 26 of the center link 12. As previously explained, the elasticity of the material surrounding the bore 26 enables the bore 26 to resume its previous dimension.

The original dimension of the center link hole 26 is less than the dimension of the end section 32 of the headless fastener 32. The headless fastener 16 is thus fixedly retained in position in the assembly of the center link 12 and the integral link 14. The shoulders 34 on the center section 30 of the headless fastener 16 will engage the surface of the center link 12 surrounding the bore 26. This prevents the headless fastener 16 from exiting the aligned bores 24, 26 of the integral link 14 and center link 12 without the application of a press applying force of equal or greater amount than the press force used for installation.

ALTERNATE EMBODIMENTS

Figure 5:
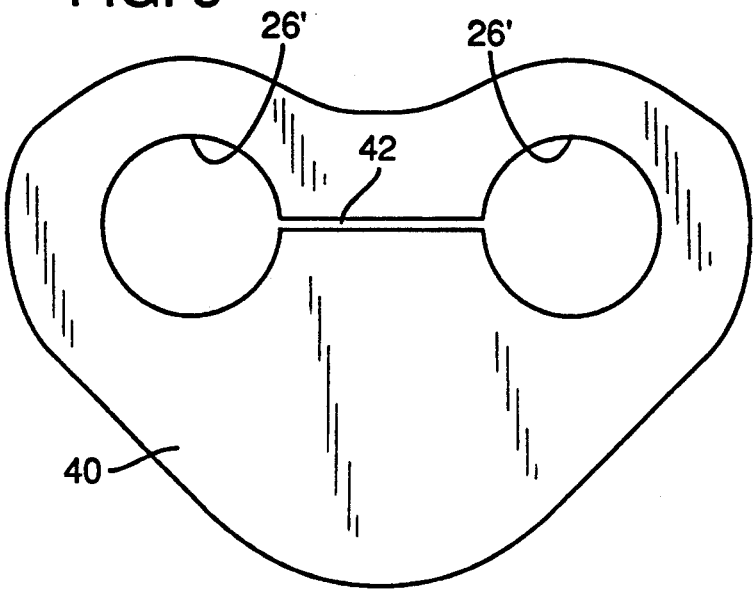
FIG. 5 is a side view of a modified center link for the embodiment of FIG. 1.

Refer now to FIG. 5 of the drawings which illustrates a center link 40. The center link 40 has through bores 26' (holes) for receiving the headless fastener 16. A slit 42 extending through the width of the center link 40 and extending from one bore 26' to the other bore 26' is provided in the center link 40. The slit 42 enhances the ability of the bore 26' to enlarge as the end section 32 of the headless fastener is forced through the bore 26'.

Figure 6:
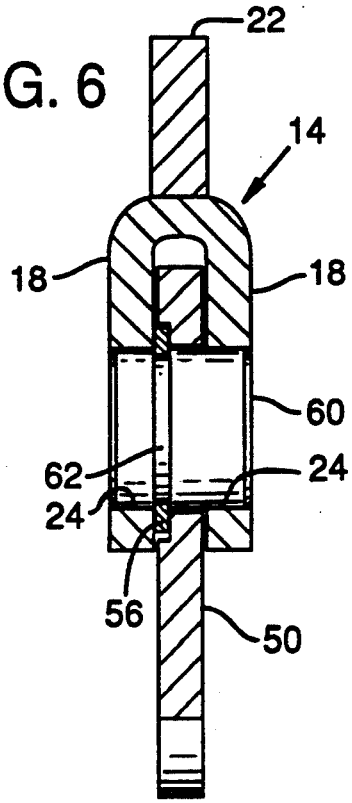
FIG. 6 is a view similar to FIG. 3 showing another embodiment of a center link and fastener.
Figure 7:
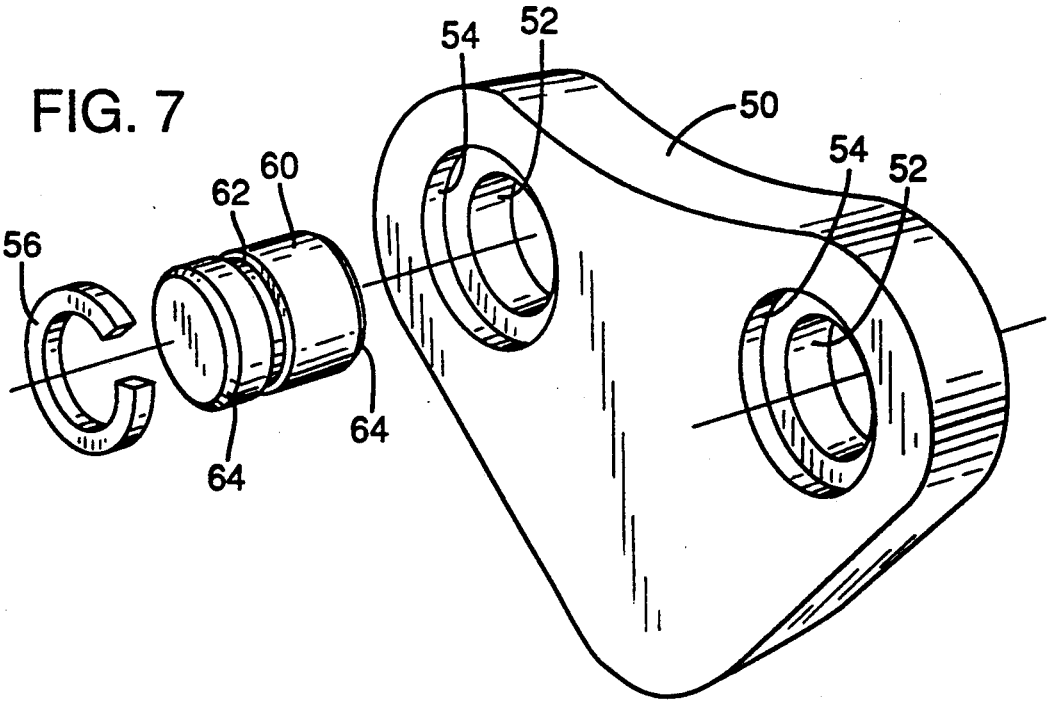
FIG. 7 is an exploded view of the center link and fastener of FIG. 6.

FIGS. 6 and 7 illustrate another embodiment of a center link and fastener. As best seen in FIG. 7, the center link 50 has through bores 52 for receiving a headless fastener. Each bore 52 has a concentric counter bore 54 on one side of the center link 50 for receiving a circular fastener 56 such as a snap ring. Each counter bore 54 is of a depth corresponding to the width of the snap ring 56 and has a diameter of sufficient size to permit the snap ring 56 to expand to receive a headless fastener. The snap ring 56 in its relaxed state has an external diameter larger than the bores 24 in the integral link 14 and an internal diameter that is less than the diameter of the headless fastener 60 (see FIG. 6).

FIGS. 6 and 7 also illustrate a headless fastener 60 for use in assembling the center link 50 to the integral link 14. The headless fastener 60 is cylindrical in shape, having a consistent diameter along its length except for an annular groove 62 formed near its center and tapers 64 (chamfers) provided on each end. The groove 62 is for receiving the snap ring 56 and has a diameter as measured at its base (bottom) that corresponds closely to the internal diameter of a relaxed snap ring 56. The groove 62 is strategically positioned on the fastener 60 so that in the assembled chain of center links 50 and integral links 14, the groove 62 will receive the snap ring 56 with the ends of the fastener 60 flush with the sides of the integral link 14 (see FIG. 6). The counter bore 54 is offset from the center of the center link 50 and therefore the groove 62 will be offset from the center of the headless fastener 60.

The saw chain is assembled as illustrated in FIG. 6 with integral links 14 and center links 50. The snap ring 56 is received in the counter bore 54 and the center link 50 is received between the side links 18 with a set of bores 24 aligned with the bore 52 of the center link 50. As the headless fastener 60 is forced into the aligned bores 24, 52, the snap ring 56 is forced to enlarge. (The taper 64 aids in forcing the snap ring 56 to enlarge). The headless fastener is inserted into the bores until the snap ring 56 is received in the groove 62. The snap ring 56 received in the groove thus retains the headless fastener 60 in the assembly of the center link 50 and integral link 14. The snap ring 56 fitting in the groove 62 prevents axial movement of the fastener 60. The snap ring fitting in the groove 62 is held captive by the counter bore 54 and the side of the link 18 adjacent the counter bore thus preventing axial movement of the fastener 60.

The saw chain of the present invention provides several advantages. Some of the advantages are as follows. The headless fastener does not extend beyond the width of the side link pair and any rubbing or frictional contact against the side of the chain will not affect the fastener. The end sections of the fastener have increased diameters which increases the effective bearing area as between the side link and the fastener. The diameters of the end sections and center section of the fastener being dimensionally close eliminates any inherent or induced stresses due to diametral changes. The headless fastener is rotatable in the center link as well as in the integral link. This aids in reducing the rate of wear since the wearing is distributed between the center link and the integral link. The compression of the material surrounding the bore 26 during the installation of the fastener (in the embodiment of FIG. 1) produces a pre-stressing of the material that has been found to be beneficial in reducing the likelihood of stress cracks forming in the center links extending from the bore 26 as a result of use.

Those skilled in the art will recognize that variations and modifications may be made without departing from the true spirit and scope of the invention. The invention is therefore not to be limited to the embodiments described and illustrated but is to be determined by the appended claims.

I claim:

1. A saw chain comprising:

interconnected center links and side link pairs, means integrally bridging the links of a side link pair rigidly together in spaced apart relation for receiving a center link therebetween, said side links having aligned through bores and said center link having a through bore defining a surrounding wall, said center link through bore being alignable with the through bores of said side links with the center link positioned between said side links, said through bores of said side links being greater in dimension that the through bore of said center link, a headless fastener having a center section of a dimension equal to or smaller than the center link through bore, and end sections on each side of said center section of a dimension greater than said center link through bore, one of said fastener and center links through bore wall being deformable to permit forced insertion of one end of the fastener through the center link through bore for placement of the end sections of the fasteners on each side of the center link, said end sections having a dimension no greater than the smallest dimension of the side link through bores and received in the through bores of the side links on either side of the center links, and said fastener and side link fastening means cooperatively configured to provide pivotal attachment of the side link pair and center link together.

2. A saw chain as defined in claim 1 wherein the center section has an axially extended dimension that accommodates the width of the center link, and the material of one of the fastener and center link being elastically deformable.

3. A saw chain as defined in claim 2 wherein forced insertion of the fastener through the center link through bore requires a force of at least about 1,000 pounds.

4. A saw chain as defined in claim 3 wherein the materials of said fastener and center link are metal with an interference fit as between the center link through bore and the fastener center section being in a range of about 0.004–0.006 inch.

5. A saw chain as defined in claim 3 wherein the forced insertion of the fastener through the center link through bore forces expansion of the center link through bore wall to achieve a secondary benefit of stress relieving the material surrounding the center link through bore to inhibit stress cracks extended from the center through bore.

6. A saw chain as defined in claim 3 wherein the center link is pre-slit from the center link through bore to permit enhanced expansion of the center link through bore for insertion of the fastener end.

7. A saw chain as defined in claim 1 which further comprises a snap ring forming a part of the center link and having a center opening that defines the center link through bore, said snap ring located between the center link and an adjacent side link having an exterior dimension greater than the side link through bores, said fastener end forced through the snap ring and the snap ring opening residing in the center section and preventing axial movement of the fastener relative to the side links.

* * * * *